US005505138A

United States Patent [19]

Newcomb et al.

[11] Patent Number: 5,505,138

[45] Date of Patent: Apr. 9, 1996

[54] SUPPORT SYSTEM FOR CONVEYOR TRACK

[75] Inventors: Michael R. Newcomb, Papillion; Kenneth R. Bermel, Omaha, both of Nebr.

[73] Assignee: Lab-Interlink, Inc., Omaha, Nebr.

[21] Appl. No.: 276,083

[22] Filed: Jul. 15, 1994

[51] Int. Cl.[6] ..... E01B 25/00

[52] U.S. Cl. ..... 104/111; 104/89; 104/109

[58] Field of Search ..... 104/89, 91, 93, 104/95, 106, 107, 109, 110, 111; 198/838, 845, 836.3, 836.4, 860.2; 16/87 R, 94 R; 248/58, 59

[56] References Cited

U.S. PATENT DOCUMENTS

| | | | |
|---|---|---|---|
| 826,605 | 7/1906 | Pflum et al. | 104/111 |
| 3,953,938 | 5/1976 | Kilgore | 104/93 |
| 4,225,035 | 9/1980 | Mohney et al. | 198/836.3 |
| 4,837,891 | 6/1989 | Toma et al. | 104/111 |
| 5,188,036 | 2/1993 | Di Rosa | 104/111 |

FOREIGN PATENT DOCUMENTS

| | | | |
|---|---|---|---|
| 1603176 | 12/1969 | Germany | 104/93 |
| 3910542 | 8/1990 | Germany | 104/93 |
| 292401 | 12/1990 | Japan | 104/33 |
| 268099 | 3/1927 | United Kingdom | 104/111 |
| 2131371 | 6/1984 | United Kingdom | 104/111 |

*Primary Examiner*—Mark T. Le
*Attorney, Agent, or Firm*—Zarley, McKee, Thomte Voorhees & Sease; Mark D. Frederiksen

[57] ABSTRACT

A conveyor track support system includes an elongated support rail with an upper horizontal planar support surface removably connected to a plurality of hangers, and preferably suspended from a ceiling above the ground. Each hanger includes a bar projecting outwardly from the lower end and a sleeve slidably journaled on the bar with set screws to adjustably retain the sleeve on the bar. A pair of ears on the top of the sleeve are spaced apart and have set screws which will selectively retain the support rail on the sleeve. The rail itself has a generally "I" shaped cross-section with an upper plate, lower plate and vertical web. A pair of vertical forward and rearward walls along the forward and rearward edges of the upper plate have inwardly directed lips along an upper edge thereof to form an upper channel above the upper plate. An upper surface of the lips forms the support surface on the top of the rail. The lower plate also includes a pair of forward and rearward walls projecting upwardly to form channels along opposite sides of the web. End caps are provided for the ends of the rail so as to retain fluids within the upper channel and the lower channels. The upper plate has a width less than the width of the lower plate such that fluid spilled from the upper channel would be retained within the lower channels of the lower plate. A pair of C-shaped connector arms are slidably journaled within the lower channels on opposite sides of the web to interconnect longitudinally abutting sections of rail. A fastener is inserted through an aperture in the connector arms and the rail web to secure the connector arms in position. Apparatus is also provided for connecting one section of rail transversely to a second section of rail, including a pair of corner clips which are interconnected between the lower plate walls of the two rails.

21 Claims, 5 Drawing Sheets

SUPPORT SYSTEM FOR CONVEYOR TRACK

TECHNICAL FIELD

The present invention relates generally to support structures for conveyor track, and more particularly to a modular rail and hanger system utilized in supporting a conveyor track for an automated laboratory.

BACKGROUND OF THE INVENTION

Clinical laboratory testing has changed and improved remarkably over the past 70 years. Initially, tests or assays were performed manually, and generally utilized large quantities of serum, blood or other materials/body fluids. As mechanical technology developed in the industrial work place, similar technology was introduced into the clinical laboratory. With the introduction of new technology, methodologies were also improved in an effort to improve the quality of the results produced by the individual instruments, and to minimize the amount of specimen required to perform a particular test.

More recently, instruments have been developed to increase the efficiency of testing procedures by reducing turnaround time and decreasing the volumes necessary to perform various assays. Present directions in laboratory testing focus on cost containment procedures and instrumentation. Laboratory automation is one area in which cost containment procedures are currently being explored. Robotic engineering has evolved to such a degree that various types of robots have been applied in the clinical laboratory setting.

The main focus of prior art laboratory automation relies on the implementation of conveyor systems to connect areas of a clinical laboratory. Known conveyor systems in the laboratory setting utilize separate conveyor segments to move specimens from a processing station to a specific laboratory work station. In order to obtain cost savings, the specimens were sorted manually, and grouped in a carrier rack to be conveyed to a specific location. In this way, a carrier would move a group of 5–20 specimens from the processing location to the specific work station for the performance of a single test on each of the specimens within the carrier rack.

With the development of new and improved automatic conveyor systems for laboratories and other environments, the inventors hereby have found a need for a support system for supporting a conveyor track above the ground while permitting flexibility in the linear arrangement of the track, as well as simple and economic modules which are easily connected to customize the support design for particular conveyor arrangements. In the prior art, conveyor track was conventionally directly suspended from a ceiling or wall support. For this reason, each and every section of conveyor track would necessarily be customized to fit a particular location.

Prior art systems for supporting conveyor track also tend to be expensive and difficult to maintain since it is necessary to shut down the entire conveyor track to remove and repair or replace any particular portion of the conveyor.

SUMMARY OF THE INVENTION

It is therefore a general object of the present invention to provide an improved modular support system for automated conveyor track.

Another object of the present invention is to provide a conveyor track support system which is quickly and easily connected in linear fashion to provide long lengths of support structure for conveyor track.

Still another object is to provide a conveyor track support system which permits quick and simple connection of modular components at intersections and corners.

Yet another object of the present invention is to provide a conveyor track support system with easily interchangeable parts that may be quickly changed and/or replaced.

These and other objects of the present invention will be apparent to those skilled in the art.

The conveyor track support system of the present invention includes an elongated support rail with an upper horizontal planar support surface removably connected to a plurality of hangers, and preferably suspended from a ceiling above the ground. Each hanger includes a bar projecting outwardly from the lower end and a sleeve slidably journaled on the bar with set screws to adjustably retain the sleeve on the bar. A pair of ears on the top of the sleeve are spaced apart and have set screws which will selectively retain the support rail on the sleeve. The rail itself has a generally "I" shaped cross-section with an upper plate, lower plate and vertical web. A pair of vertical forward and rearward walls along the forward and rearward edges of the upper plate have inwardly directed lips along an upper edge thereof to form an upper channel above the upper plate. An upper surface of the lips forms the support surface on the top of the rail. The lower plate also includes a pair of forward and rearward walls projecting upwardly to form channels along opposite sides of the web. End caps are provided for the ends of the rail so as to retain fluids within the upper channel and the lower channels. The upper plate has a width less than the width of the lower plate such that fluid spilled from the upper channel would be retained within the lower channels of the lower plate. A pair of C-shaped connector arms are slidably journaled within the lower channels on opposite sides of the web to interconnect longitudinally abutting sections of rail. A fastener is inserted through an aperture in the connector arms and the rail web to secure the connector arms in position. Apparatus is also provided for connecting one section of rail transversely to a second section of rail, including a pair of corner clips which are interconnected between the lower plate walls of the two rails.

DESCRIPTION OF THE PREFERRED EMBODIMENT

Figure 1:
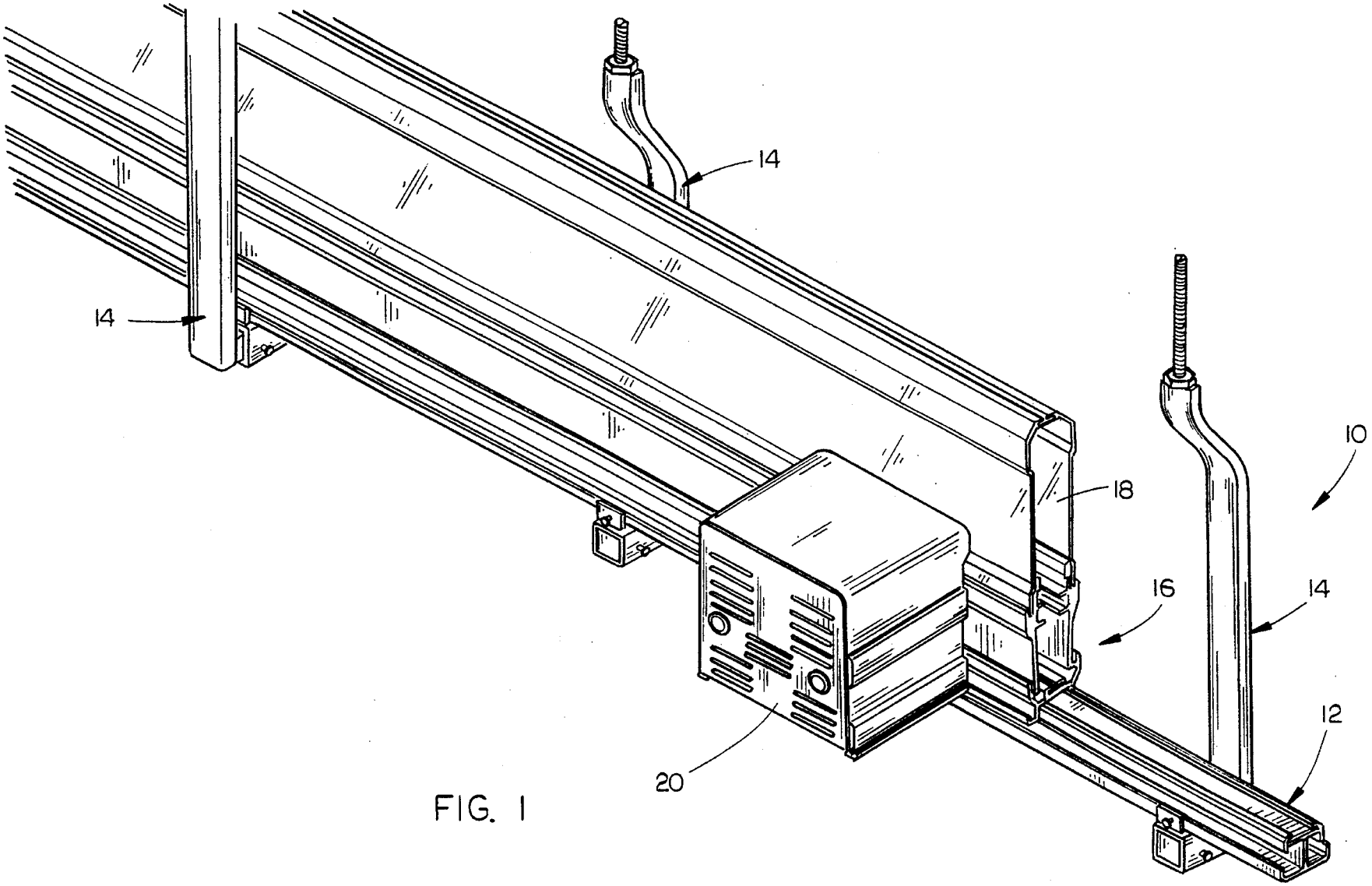
FIG. 1 is a perspective view of the support system of the present invention with conveyor track attached thereto.

Referring now to the drawings, in which identical or corresponding pads are identified with the same reference numeral, and more particularly to FIG. 1, the support system of the present invention is designated generally at 10 and includes sections of support rail 12 connected to a plurality of hangers 14 to support a conveyor track 16 above the ground. As shown in FIG. 1, conveyor track 16 includes a cover 18 and various components such as a drive mechanism designated generally at 20.

Figure 2:
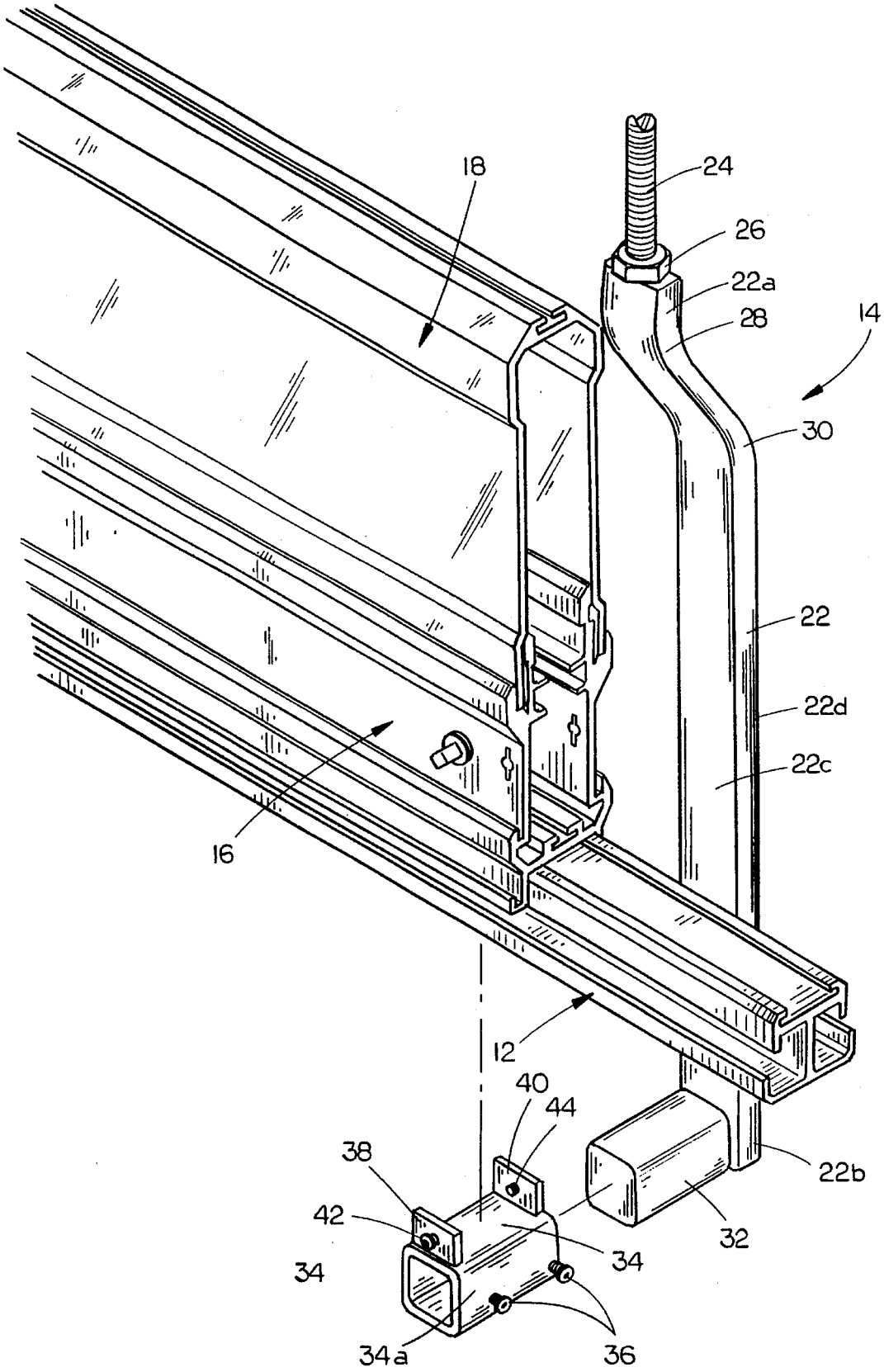
FIG. 2 is an enlarged exploded perspective view showing the connection of the support rail to a support system hanger.
Figure 3A:
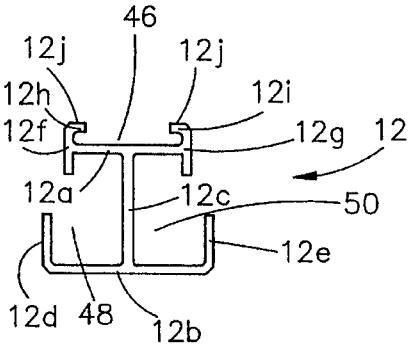
FIG. 3 is an end view of FIG. 2 showing the support rail fastened in position on a hanger.
Figure 3:
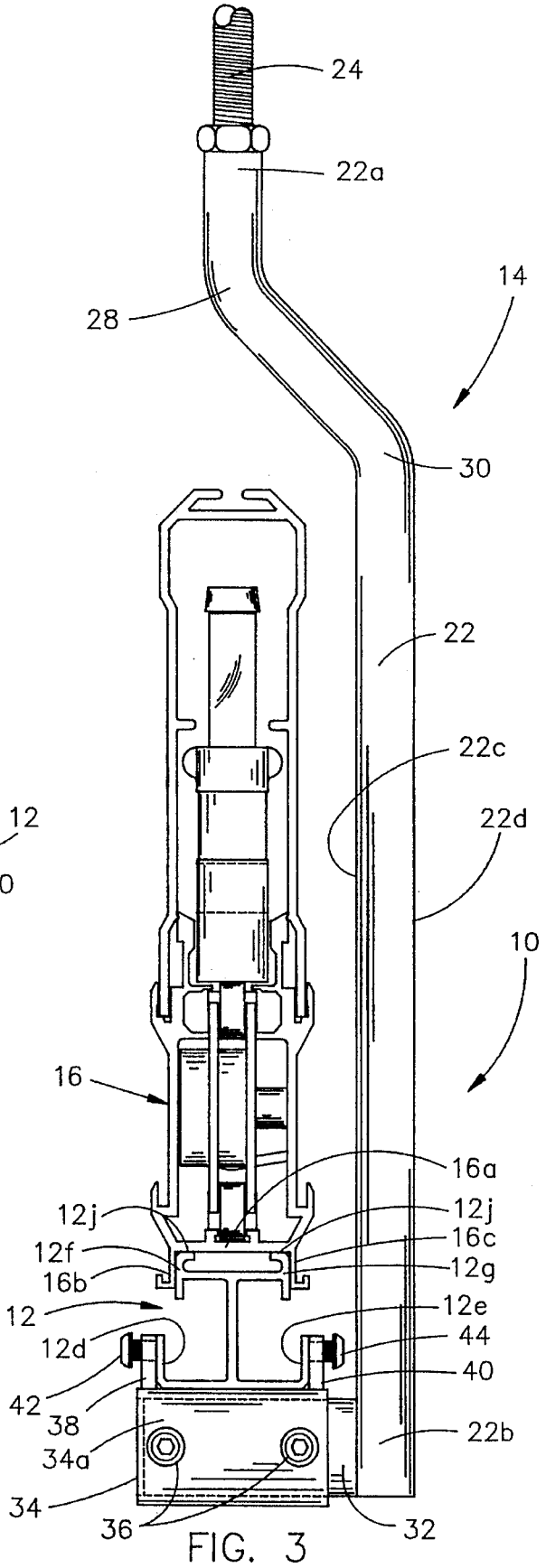

Referring now to FIGS. 2 and 3, each hanger 14 includes an elongated strap 22 having upper and lower ends 22*a* and 22*b* respectively. A threaded rod 24 is mounted on the upper end 22*a* and projects upwardly therefrom for engagement with an overhead support, such as a ceiling or other structure. A nut 26 threaded on rod 24 permits "fine tuning" of the vertical adjustment of strap 22.

Strap 22 includes a forward face 22*c*, and rearward face 22*d*, and is bent rearwardly from the vertical at a point slightly below the upper end 22*a*, at a bend designated generally at 28. A second bend 30, spaced below first bend 28 orients the remainder of the lower portion of the strap 22 in a vertical position parallel with the upper end 22*a*. A bar 32 is affixed to the forward face 22*c* of strap 22 at the lower end 22*b* thereof and projects forwardly therefrom a distance so as to have a portion located vertically under upper end 22*a* and rod 24 (as shown in FIG. 3). In this way, hanger 14 will support a rail section 12, and conveyor track 16 vertically under rod 24, with a center of gravity aligned with rod 24. This orientation insures that conveyor track 16 will remain vertical, with a center of gravity aligned vertically under rod 24.

As shown in FIG. 2, a tubular sleeve 34 is provided with an interior opening matching the cross-section of bar 32, to receive bar 32 therein. A pair of set screws 36 threaded through a side wall 34*a* of sleeve 34 selectively secure sleeve 34 in the desired position on bar 32.

A forward and rearward ear 38 and 40 project upwardly from the upper wall 34*b* of sleeve 34 and are spaced apart adjacent the forward and rearward ends of sleeve 34. A set screw 42 is threaded through an aperture in forward ear 38 so as to project rearwardly through forward ear 38, while a set screw 44 is threaded through an aperture in rearward ear 40 so as to project forwardly through rearward ear 40. As shown in FIG. 3, set screws 42 and 44 will retain a section of rail 12 in removably affixed position between ears 38 and 40.

Referring now to FIG. 3*a*, each rail section 12 has a generally "I" shaped cross-section with an upper horizontal plate 12*a* connected to a lower horizontal plate 12*b* by a vertical web 12*c*. Upper plate 12*a* has a width less than that of lower plate 12*b*. Lower plate 12*b* has an upwardly projecting forward wall 12*d* parallel to web 12*c*, and an opposing rearward wall 12*e* projecting upwardly parallel to web 12*c* and forward wall 12*d*. Upper plate 12*a* also has a pair of spaced apart forward and rearward walls 12*f* and 12*g* at the forward and rearward ends thereof, oriented parallel to web 12*c* and located vertically inwardly of lower plate wall 12*d* and 12*e*. Upper plate walls 12*f* and 12*g* each have an upper lip 12*h* and 12*i*, respectively, bent inwardly towards one another to form a pair of coplanar horizontal support surfaces 12*j*.

Referring once again to FIG. 3, it can be seen that the design of rail 12 provides many advantages in the support system 10 of the present invention. For example, lower plate forward and rearward walls 12*d* and 12*e* provide vertical surfaces against which set screws 42 and 44 are biased to retain rail 12 in position on hanger support sleeve 34. In addition, the upper support surfaces 12*j* support the bottom of conveyor track 16, while upper plate forward and rearward walls 12*f* and 12*g* retain the depending walls 16*b* and 16*c* of conveyor track 16 to prevent transverse movement of track 16 on rail 12.

Support rail 12 also includes fluid retention capabilities by virtue of its structural design. As shown in FIG. 3*a*, a channel 46 with an upwardly directed opening is formed by top plate 12*a* and the upwardly projecting portions of top plate walls 12*f* and 12*g*. Channel 46 will thereby retain fluid therein which may leak or spill from track 16, especially at joints between longitudinal sections of track 16 which abut over channel 46 in rail 12. In addition, a pair of channels 48 and 50 are formed on opposing sides of web 12*c* by lower plate 12*b* and lower plate walls 12*d* and 12*e*. Because upper plate 12*a* has a width less than lower plate 12*b*, any fluid spilling over from channel 46 would be retained within lower channels 48 and 50.

Figure 4:
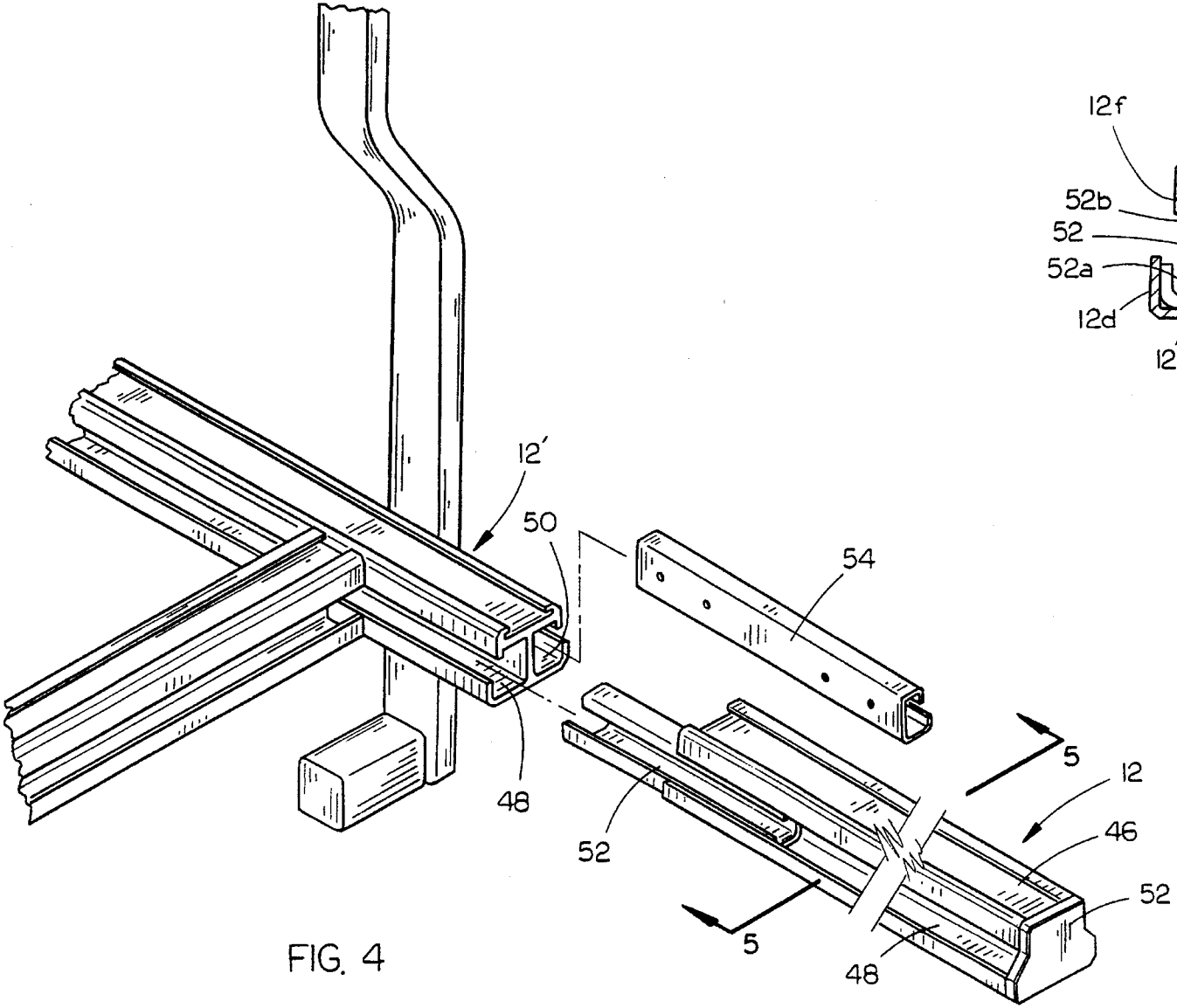
FIG. 4 is an exploded perspective view of an end to end connection of two sections of support rail.

A shown in FIG. 4, an end cap 51 is provided for the end of a projecting support rail 12, and serves to retain fluid within upper channel 46 and lower channels 48 and 50.

Figure 5:
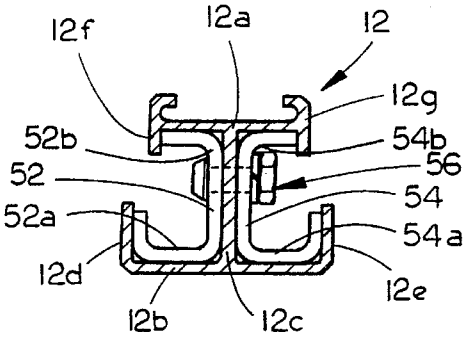
FIG. 5 is a sectional view taken at 5—5 in Figure.

FIGS. 4 and 5 demonstrate the preferred method for longitudinally connecting sections of rail 12. In FIG. 4, an end section of rail 12 is shown exploded from a second rail section 12'. A pair of connector arms 52 and 54 are slidably received within channels 48 and 48' and 50 and 50' of rail sections 12 and 12', respectively. As shown in FIG. 5, connector arm 52 includes a lower half of 52*a* which snugly fits between web 12*c* and lower plate forward wall 12*d* on lower plate 12*b*. An upper portion 52*b* of connector 52 snugly fits between web 12*c* and upper plate forward wall 12*f* and against upper plate 12*a*. Similarly, connector 54 has a lower portion 54*a* fitting between web 12*c* and lower plate rearward wall 12*e*, and an upper portion 54*b* fitting snugly between web 12*c* and upper plate rearward wall 12*g*. A nut and screw fastener 56 extends through apertures in connectors 52 and 54, as well as web 12*c* of rail 12 to affix the connectors in position. A similar nut and bolt retain the opposite end of connectors 52 and 54 in position on rail section 12'.

As shown in FIG. 4, a gasket 55 is interposed between the abutting ends of first and second rails 12 and 12' to provide a fluidly sealed abutting connection. While a gasket 55 is shown in the drawings, the inventors contemplate other methods of sealing the connection, such as caulk or the like.

Figure 6:
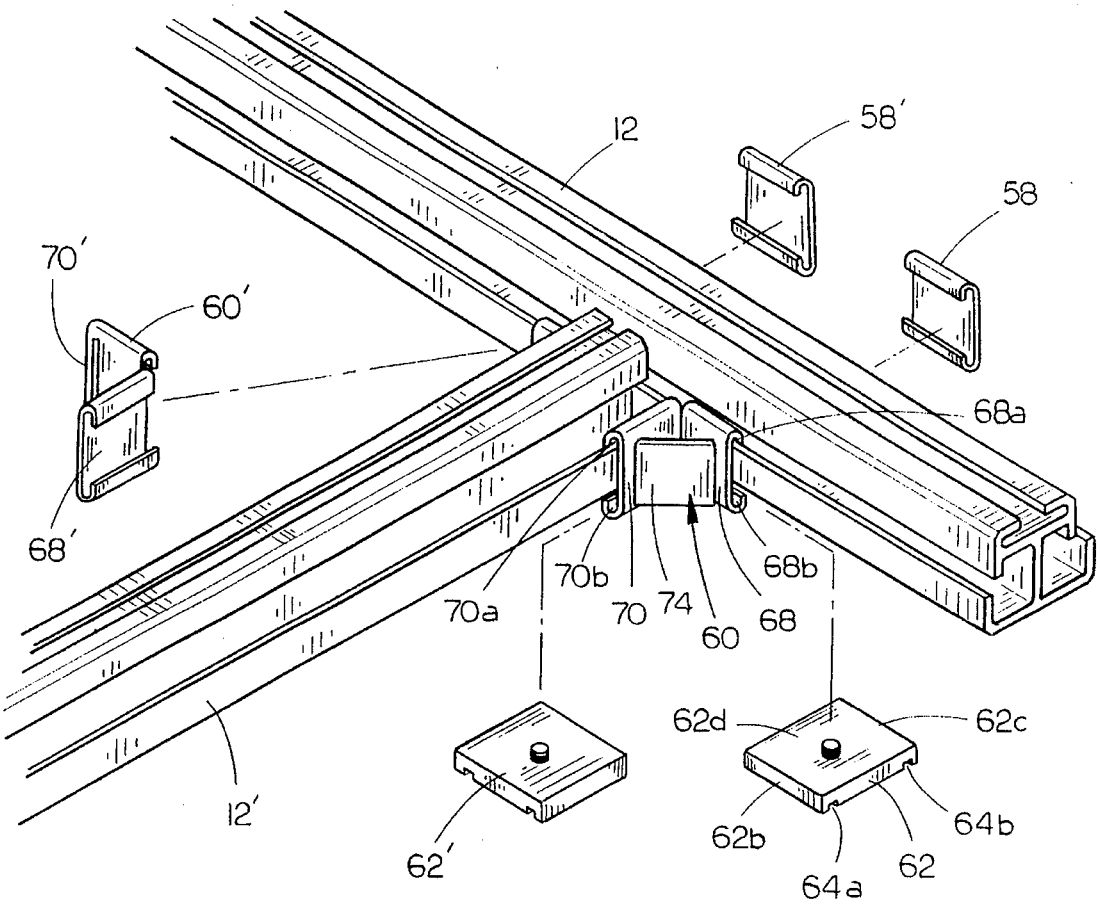
FIG. 6 is an enlarged perspective view a "T" intersection of two sections of rail, with the connector components shown in exploded view.
Figure 7:
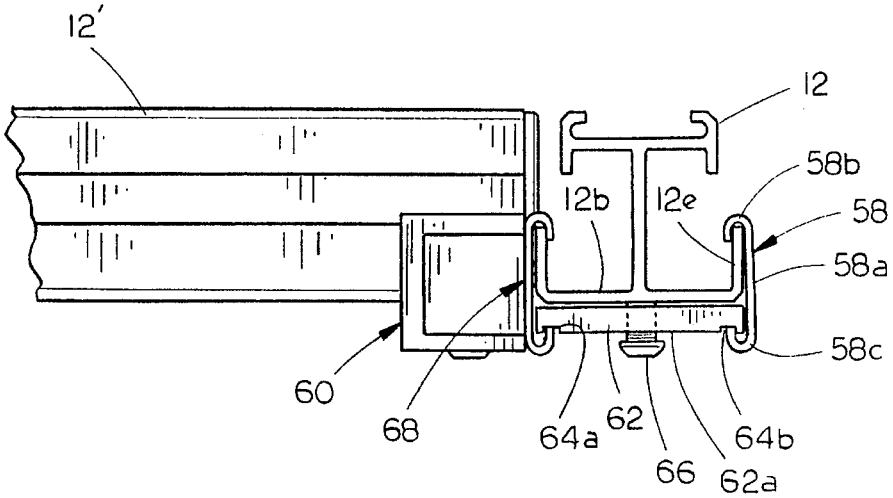
FIG. 7 is an end view of the intersection shown in FIG. 6.

FIGS. 6 and 7 show a "T" intersection of a first rail 12 and a second rail 12'. The intersection assembly includes three major components: (A) a pair of straight clips 58 and 58', (B) a pair of corner clips 60 and 60', and (C) retainer plates 62, 62' and a third plate not shown.

Each retainer plate 62 is a generally square-shaped member with a pair of spaced apart and parallel slots 64*a* and 64*b* formed in the bottom surface 62*a* thereof, adjacent forward and rearward ends 62*b* and 62*c* respectively. A set screw 66 is threaded through an aperture formed generally centrally in plate 62 with the screw shank projecting through the upper surface 62*d* of retainer plate 62 and the head projecting below the lower surface 62*a*. As shown in FIG. 7, straight clip 58 has a generally vertical and flat back 58*a* with hook-shaped upper and lower ends 58*b* and 58*c*. The upper hook end 58*b* is hooked onto the upper edge of lower plate rearward wall 12*e*, and the lower hook end 58*c* is hooked in retainer plate rearward slot 64*b* when retainer plate 62 is positioned against the bottom surface of rail lower plate 12*b*.

Corner clip 60 includes a pair of straight clips 68 and 70 affixed at a predetermined angle with respect to one another. Straight clips 68 and 70 of corner clip 60 each include upper and lower hooked ends 68*a*, 68*b*, 70*a* and 70*b*, respectively, as shown in FIG. 6. A generally vertical gusset panel 74 is affixed between clips 68 and 70 to maintain the predetermined angle.

As shown in FIG. 7, one edge of retainer plate 62 is clipped to rail 12 by straight clip 58, while the other edge is retained by clip 68 of corner clip 60 in the same fashion. Set screw 66 is then threaded upwardly to force retainer plate 62 downwardly so as to positively engage clips 58 and 68.

As shown in FIG. 6, rail 12' is retained at a predetermined angle relative to rail 12 by the second clip 70 of corner clip 60, a first clip 68' of corner clip 60', and the second retainer plate 62' connected therebetween. A similar arrangement connects the second clip 70' of corner clip 60' with clip 58' and a third retainer plate (not shown) on rail 12. It can be seen that this arrangement will securely maintain rail 12' at a predetermined angular relationship with rail 12.

Whereas the invention has been shown and described in connection with the preferred embodiment thereof, it will be understood that many modifications, substitutions and additions may be made which are within the intended broad scope of the appended claims.

We claim:

1. A conveyor track support system, comprising in combination:

an elongated length of track having first and second longitudinal ends and a longitudinal base plate; and a generally horizontal support rail positioned under said track base plate and extending the longitudinal length thereof, for supporting the track above the ground;

said support rail having opposing longitudinal ends and a generally "I" shaped cross-section with a horizontal upper plate connected to a horizontal lower plate by a vertical web;

said rail including a horizontal planar support surface forming an uppermost end thereof; and a hanger removably connected to said rail for supporting the rail spaced above the ground.

2. The support system of claim 1, wherein said hanger includes:

a generally vertical strap having upper and lower ends and forward and rearward faces;

a bar projecting forwardly from the lower end of said strap; and means for removably connecting said rail to said bar, for supporting said rail on said hanger.

3. The support system of claim 2, wherein said means for removably connecting the rail to the bar includes:

a sleeve slidably journaled on said bar;

said sleeve having means for removably retaining said rail on the sleeve; and said sleeve further including means for selectively preventing slidable movement of the sleeve on the bar.

4. The support system of claim 3, wherein said means for selectively preventing slidable movement includes a set screw threaded through a wall of the sleeve for selective biasing engagement with said bar.

5. A conveyor track support system, comprising:

a support rail having opposing longitudinal ends and a generally "I" shaped cross-section with a horizontal upper plate connected to a horizontal lower plate by a vertical web;

said rail including a horizontal planar support surface forming an uppermost end thereof; and a hanger removably connected to said rail for supporting the rail spaced above the ground, said hanger including:

a generally vertical strap having upper and lower ends and forward and rearward faces;

a bar projecting forwardly from the lower end of said strap; and means for removably connecting said rail to said bar, for supporting said rail on said hanger;

said means for removably connecting the rail to the bar including a sleeve slidably journaled on said bar;

said sleeve having means for removably retaining said rail on the sleeve;

said sleeve further including means for selectively preventing slidable movement of the sleeve on the bar;

said means for removably retaining said rail including:

a pair of spaced apart ears projecting upwardly from said sleeve;

said rail lower plate removably journaled between said ears; and restraining means for selectively restraining said rail between said ears.

6. The support system of claim 5, wherein said restraining means includes a set screw threaded through one of said ears for selectively biasing said rail against the opposite ear.

7. The support system of claim 1, wherein said rail lower plate includes a forward longitudinal edge and a rearward longitudinal edge, and further comprising a forward wall projecting upwardly continuously along the lower plate forward edge and a rearward wall projecting upwardly continuously along the lower plate rearward edge.

8. The support system of claim 6, wherein said rail lower plate includes a forward longitudinal edge and a rearward longitudinal edge, and further comprising a forward wall projecting upwardly continuously along the lower plate forward edge and a rearward wall projecting upwardly continuously along the lower plate rearward edge, and wherein said set screw is located so as to bias against said lower plate forward wall.

9. The support system of claim 1, wherein said rail upper plate includes a forward longitudinal edge and a rearward longitudinal edge, and further comprising:

a forward wall with a portion projecting upwardly continuously along the upper plate forward edge;

a rearward wall with a portion projecting upwardly continuously along the upper plate rearward edge;

a forward lip projecting rearwardly continuously along an upper edge of the upper plate forward wall and having an upper planar surface; and a rearward lip projecting forwardly continuously along an upper edge of the upper plate rearward wall and having an upper planar surface coplanar with the forward lip upper surface;

wherein said rail planar support surface is formed by said forward and rearward lip upper surfaces.

10. A conveyor track support system, comprising:

a support rail having opposing longitudinal ends and a generally "I" shaped cross-section with a horizontal upper plate connected to a horizontal lower plate by a vertical web;

said rail including a horizontal planar support surface forming an uppermost end thereof; and a hanger removably connected to said rail for supporting the rail spaced above the ground;

said rail lower plate including a forward longitudinal edge and a rearward longitudinal edge, and further comprising a forward wall projecting upwardly continuously along the lower plate forward edge and a rearward wall protecting upwardly continuously along the lower plate rearward edge;

said rail upper plate including a forward longitudinal edge and a rearward longitudinal edge, and further comprising:

a forward wall with a portion projecting upwardly continuously along the upper plate forward edge;

a rearward wall with a portion projecting upwardly continuously along the upper plate rearward edge;

a forward lip projecting rearwardly continuously along an upper edge of the upper plate forward wall and having an upper planar surface; and a rearward lip projecting forwardly continuously along an upper edge of the upper plate rearward wall and having an upper planar surface coplanar with the forward lip upper surface;

wherein said rail planar support surface is formed by said forward and rearward lip upper surfaces.

11. The support system of claim 10, wherein said lower plate forward and rearward walls are spaced apart a distance greater than the upper plate forward and rearward walls.

12. The support system of claim 11, further comprising end caps for sealing the ends of said rail, each said end cap including a lower wall portion extending from the lower plate upwardly a height at least equal to the height of the lower plate forward and rearward walls and extending transversely therebetween, and each end cap including an upper wall portion extending from the upper plate upwardly at least to the lip upper surfaces and transversely between said upper plate forward and rearward walls.

13. The support system of claim 7, further comprising means for removably connecting a first rail longitudinally with a second rail with the upper support surfaces of the first and second rails coplanar.

14. The support system of claim 13, wherein said means for removably connecting the first rail to the second rail includes a first elongated connector arm having first and second ends, the first end removably connected to a first end of the first rail web, and the second end removably connected to a first end of the second rail web, with the first rail first end in abutting contact with the second rail first end, said first and second rails in longitudinal alignment.

15. The support system of claim 10, wherein said upper plate forward and rearward walls each include a portion depending downwardly from the upper plate forward and rearward edges, respectively, and wherein said web is located centrally between said lower plate forward and rearward walls and said upper plate forward and rearward walls.

16. The support system of claim 15, wherein said means for removably connecting the first and second rail includes:

a first elongated connector arm having first and second ends, the first end journaled between the web and upper and lower plate forward walls on the first rail first end, and the second end journaled between the web and upper and lower plate forward walls on the second rail first end;

a second elongated connector arm having first and second ends, the first end journaled between the web and upper and lower plate rearward walls on the first rail first end, and the second end journaled between the web and upper and lower plate rearward walls on the second rail first end;

a first fastener removably fastening the first ends of the first and second connector arms to the first rail web; and a second fastener removably fastening the second ends of said first and second connector arms to the second rail web.

17. The support system of claim 16, wherein:

said first connector arm is generally "C" shaped in cross-section and includes a top leg with a width equal to the distance from the rail web to the upper plate forward wall, a back with a height equal to the distance between the upper and lower plates, and a lower leg with a width equal to the distance between the web and the lower plate forward wall; and said second connector arm being identical to the first connector arm.

18. The support system of claim 17, wherein each said connector arm includes an upwardly projecting lip affixed continuously along a forward edge of the lower leg, and affixed at an angle parallel with the lower plate forward wall.

19. The support system of claim 7, further comprising means for removably connecting a first rail transversely relative to a second rail, with the first rail first end located intermediate the second rail ends, and with the upper support surfaces of the first and second rails coplanar.

20. A conveyor track support system, comprising:

a support rail having opposing longitudinal ends and a generally "I" shaped cross-section with a horizontal upper plate connected to a horizontal lower plate by a vertical web;

said rail including a horizontal planar support surface forming an uppermost end thereof; and a hanger removably connected to said rail for supporting the rail spaced above the ground, said rail lower plate including a forward longitudinal edge and a rearward longitudinal edge, and further comprising a forward wall projecting upwardly continuously along the lower plate forward edge and a rearward wall projecting upwardly continuously along the lower plate rearward edge;

means for removably connecting a first rail transversely relative to a second rail, with the first rail first end located intermediate the second rail ends, and with the upper support surfaces of the first and second rails coplanar;

said means for removably connecting the first rail transversely relative to the second rail, including:

a first corner clip removably connecting the first rail first end lower plate rearward wall to the second rail lower plate forward wall; and a second corner clip removably connecting the first rail first end lower plate forward wall to the second rail lower plate forward wall.

21. The support system of 20, wherein said means for removably connecting the first rail transversely relative to the second rail further includes:

a first retainer plate positioned under said second rail lower plate rearwardly and adjacent the first corner clip, said first retainer plate including forward and rearward edges and upper and lower surfaces;

a first straight clip having a lower end connected to the first retainer plate rearward edge, and an upper end connected to a portion of the second rail lower plate rearward wall;

said first corner clip including a first clip portion with a lower end connected to the first retainer plate forward edge and an upper end connected to a portion of said second rail lower plate forward wall;

a second retainer plate positioned under said first rail lower plate between said first and second corner clips, said second retainer plate including forward and rearward edges and upper and lower surfaces;

said first corner clip including a second clip portion with an upper end connected to the second retainer plate rearward edge, and an upper end connected to a portion of said first rail lower plate rearward wall;

said second corner clip including first and second clip portions, the second clip portion including an upper end connected to a portion of the first rail lower plate forward wall and a lower end connected to the second retainer plate forward edge;

a third retainer plate positioned under said second rail lower plate rearwardly and adjacent the second corner clip first clip portion, said third retainer plate including forward and rearward edges and upper and lower surfaces;

said second corner clip first portion having an upper end connected to a portion of said second rail lower plate forward wall and a lower end connected to said third retainer plate forward edge; and a second straight clip having an upper end connected to a portion of the second rail lower plate rearward wall and a lower end connected to the third retainer plate rearward edge;

said first corner clip having said first and second clip portions mounted at a predetermined angle of less than 180° relative to one another, and said second corner clip having said first and second clip portions mounted at a predetermined angle supplementary to the angle of the first corner clip.

* * * * *